US007462588B2

(12) United States Patent
Bayersdoerfer et al.

(10) Patent No.: US 7,462,588 B2
(45) **Date of Patent: *Dec. 9, 2008**

(54) DISHWASHER DETERGENTS COMPRISING A SPECIFIC POLYMER MIXTURE

(75) Inventors: Rolf Bayersdoerfer, Hamburg (DE); Arnd Kessler, Monheim-Baumberg (DE); Silke Menke, Haan (DE)

(73) Assignee: Henkel Kommanditgesellschaft auf Aktien (Henkel KGaA), Dusseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/373,808

(22) Filed: Mar. 10, 2006

(65) Prior Publication Data

US 2006/0223734 A1 Oct. 5, 2006

Related U.S. Application Data

(63) Continuation of application No. PCT/EP2004/009894, filed on Sep. 4, 2004.

(30) Foreign Application Priority Data

Sep. 15, 2003 (DE) ..... 103 42 631

(51) Int. Cl.
*C11D 1/66* (2006.01)
*C11D 3/34* (2006.01)
*C11D 3/36* (2006.01)
*C11D 3/37* (2006.01)

(52) U.S. Cl. ..... 510/220; 510/222; 510/228; 510/230; 510/467; 510/475; 510/495; 510/499; 510/504

(58) Field of Classification Search ..... 510/220, 510/222, 228, 230, 467, 475, 495, 499, 504
See application file for complete search history.

(56) References Cited

U.S. PATENT DOCUMENTS

| | | | | |
|---|---|---|---|---|
| 4,749,758 | A | 6/1988 | Dursch | |
| 6,025,314 | A | 2/2000 | Nitsch | |
| 6,200,937 | B1 | 3/2001 | Perassinoto | |
| 6,326,343 | B1 * | 12/2001 | Ghatlia et al. | 510/222 |
| 6,962,898 | B2 | 11/2005 | Kessler | |
| 7,012,048 | B2 * | 3/2006 | Drovetskaya et al. | 510/123 |
| 2003/0158064 | A1 | 8/2003 | Kessler | |
| 2004/0005990 | A1 | 1/2004 | Aubay | |

FOREIGN PATENT DOCUMENTS

| | | |
|---|---|---|
| DE | 100 32 612 | 2/2002 |
| EP | 0 077 588 | 4/1983 |
| EP | 0 165 452 | 12/1985 |
| EP | 0 197 434 | 10/1986 |
| EP | 0 405 818 | 1/1991 |
| EP | 0 664 334 | 7/1995 |
| EP | 0 851 024 | 7/1997 |
| EP | 0 824 147 | 2/1998 |
| EP | 0 835 925 | 4/1998 |
| EP | 0 877 076 | 11/1998 |
| WO | WO 97/09408 | 3/1997 |
| WO | WO 99/05248 | 2/1999 |
| WO | WO 01/12769 | 2/2001 |
| WO | WO 01/85890 | 11/2001 |
| WO | WO 02/04583 | 1/2002 |
| WO | WO 02/20709 | 3/2002 |
| WO | WO 03/060054 | 7/2003 |
| WO | WO 03/099980 | 12/2003 |

OTHER PUBLICATIONS

U.S. Appl. No. 11/375,616, filed Mar. 14, 2006, Bayersdoerfer.

* cited by examiner

*Primary Examiner*—Brian P Mruk
(74) *Attorney, Agent, or Firm*—John S. Child, Jr.

(57) ABSTRACT

The present invention relates to detergents and rinse agents for machine dishwashing and to supply forms which combine detergent and rinse agent containing certain polymers in a single product comprising at least one polymer with cationic monomer units and at least one anionic polymer modified with phosphorus- and/or sulfur-containing groups, characterized in that the pH value of a 1% by weight solution of the anionic polymer in distilled water at 20° C. is less than pH 6.

14 Claims, No Drawings

DISHWASHER DETERGENTS COMPRISING A SPECIFIC POLYMER MIXTURE

(b) CROSS-REFERENCE TO RELATED APPLICATIONS

This application is a continuation under 35 U.S.C. § 365(c) and 35 U.S.C. § 120 of International Application PCT/EP 2004/009894, filed Sep. 4, 2004. This application also claims priority under 35 U.S.C. § 119 of German application DE 103 42 631.0, filed Sep. 15, 2003. The International application and the German application are incorporated herein by reference in their entireties.

(c) STATEMENT REGARDING FEDERALLY SPONSORED RESEARCH OR DEVELOPMENT

Not Applicable

(d) INCORPORATION-BY-REFERENCE OF MATERIAL SUBMITTED ON A COMPACT DISC

Not Applicable

(e) BACKGROUND OF THE INVENTION (1) Field of the Invention

The invention relates to detergents and rinse agents for machine dishwashing. More particularly, the present invention relates to detergents and rinse agents for machine dishwashing and to supply forms which combine detergent and rinse agent containing certain polymers in a single product. These detergents/rinse agents are generically referred to hereinafter as "detergents for machine dishwashing" or "dishwasher detergents."

Today, machine-washed tableware has to meet stricter requirements than hand-washed tableware. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried.

Accordingly, to obtain bright, spotless tableware, rinse agents are now successfully used. The addition of rinse agent at the end of the wash program ensures that the water drains completely from the tableware so that the various surfaces are bright and free from residues at the end of the dishwashing program.

The cleaning of tableware in domestic dishwashing machines normally comprises a pre-rinse cycle, a main wash cycle and a final rinse cycle which are interrupted by intermediate rinse cycles. With most machines, the pre-rinse cycle can be selected for heavily soiled tableware, but is only selected by the consumer in exceptional cases so that, in most machines, a main wash cycle, an intermediate rinse cycle with clean water and a final rinse cycle are carried out. The temperature of the main wash cycle varies between 40 and 65° C., according to the type of machine and the program selected. In the final rinse cycle, rinse aids which normally contain nonionic surfactants as their main constituent are added from a dosing tank. These rinse aids are liquids and are widely described in the prior art. Their principal function is to prevent lime stains and bloom on the cleaned tableware. Besides water and low-foaming nonionic surfactants, many rinse aids often contain hydrotropes, pH regulators, such as citric acid, or bloom-inhibiting polymers.

(2) Description of Related Art, Including Information Disclosed Under 37 C.F.R. §§ 1.97 and 1.98

EP-B1 0 197 434 (Henkel) describes liquid rinse agents which contain mixed ethers as nonionic surfactants. A wide variety of materials (glass, metal, silver, plastic, china) is cleaned in dishwashers. These various materials have to be thoroughly wetted in the final rinse cycle. Rinse agent formulations containing only mixed ethers as their surfactant component satisfy these requirements inadequately, if at all, so that the clear rinse effect or drying effect is unsatisfactory, particularly on plastic surfaces.

The storage tank in the dishwashing machine has to be filled with rinse agent at regular intervals, one filling being enough for 10 to 50 rinse cycles according to the type of machine. If the consumer forgets to fill the tank, glasses in particular are spoiled by lime stains and bloom. Accordingly, some proposals have been put forward in the prior art with a view to integrating a rinse agent in dishwasher detergents. These proposed solutions are confined to tablets.

Thus, European patent application EP-A-0 851 024 (Unilever) describes two-layer detergent tablets of which the first layer contains peroxy bleaching agent, builder and enzyme while the second layer contains an acidifying agent, a continuous medium with a melting point of 55 to 70° C. and bloom inhibitors. The high-melting continuous medium is said to release the acid(s) and bloom inhibitor(s) with delay and to develop a clear rinse effect. Powder-form dishwasher detergents or surfactant-containing rinse agent systems are not mentioned in this document.

(f) BRIEF SUMMARY OF THE INVENTION

The problem addressed by the present invention was to provide new rinse agents dishwasher detergents which would at least match commercially available rinse agents in their performance properties and which, in addition, would afford other performance-related advantages. The new rinse agents would be usable both as conventional rinse agents and in the form of combination products and would develop their favorable properties irrespective of their supply form. Not least, the new rinse agents would also be usable in conventional machine dishwashing detergents, i.e. they would also afford performance-related advantages as an added component.

It has now been found that the use of anionic polymers modified with P- and/or S-containing groups in machine dishwashing detergents produces advantageous effects. It is of particular advantage if the polymers are used in the final rinse cycle.

In a first embodiment, therefore, the present invention relates to a dishwasher detergent comprising at least one polymer with cationic monomer units and at least one anionic polymer modified with phosphorus- and/or sulfur-containing groups, characterized in that the pH value of a 1% by weight solution of the anionic polymer in distilled water at 20° C. is less than pH 6.

According to the invention, the detergents contain at least one polymer which bears P-containing groups and which has a pH below 6 in the form of a 1% by weight solution in distilled water at 20° C. These polymers may emanate from different groups. Besides unsaturated carboxylic acids, preferred polymers contain P- and/or S-containing monomers as monomer units. Preferred polymers additionally contain other ionic or nonionic monomers.

Preferred dishwasher detergents according to the invention are characterized in that the polymer with cationic monomer units is a cationic polymer.

(g) BRIEF DESCRIPTION OF THE SEVERAL VIEWS OF THE DRAWING(S)

Not Applicable (h) DETAILED DESCRIPTION OF THE INVENTION

"Cationic polymers" in the context of the present invention are polymers which carry a positive charge in the polymer molecule. This positive charge can be achieved, for example, through (alkyl) ammonium groups or other positively charged groups present in the polymer chain.

Particularly preferred cationic polymers emanate from the groups of quaternized cellulose derivatives, polysiloxanes carrying quaternary groups, cationic guar derivatives, polymeric dimethyl diallyl ammonium salts and copolymers thereof with esters and amides of acrylic acid and methacrylic acid, copolymers of vinyl pyrrolidone with quaternized derivatives of dialkyl aminoacrylate and methacrylate, vinyl pyrrolidone/methoimidazolinium chloride copolymers, quaternized polyvinyl alcohols or the polymers known under the INCI names of Polyquaternium 2, Polyquaternium 17, Polyquaternium 18 and Polyquaternium 27.

Another possibility is that the polymer carries not only cationic groups, but also anionic groups. Corresponding polymers emanate from the groups of zwitterionic or amphoteric polymers.

Accordingly, preferred dishwasher detergents according to the invention are characterized in that the polymer with cationic monomer units is an amphoteric polymer.

Preferred amphoteric polymers emanate from the group of alkyl acrylamide/acrylic acid copolymers, alkyl acrylamide/methacrylic acid copolymers, alkyl acrylamide/methylmethacrylic acid copolymers, alkyl acrylamide/acrylic acid/alkylaminoalkyl (meth)acrylic acid copolymers, alkyl acrylamide/methacrylic acid/alkylaminoalkyl (meth)acrylic acid copolymers, alkyl acrylamide/methylmethacrylic acid/alkyl aminoalkyl (meth)acrylic acid copolymers, alkyl acrylamide/alkyl methacrylate/alkyl aminoethyl methacrylate/alkyl methacrylate copolymers and copolymers of unsaturated carboxylic acids, cationically derivatized unsaturated carboxylic acids and optionally other ionic or nonionic monomers.

Preferred zwitterionic polymers emanate from the group of acrylamidoalkyl trialkylammoniumchloride/acrylic acid copolymers and alkali metal and ammonium salts thereof, acrylamidoalkyl trialkylammoniumchloride/ methacrylic acid copolymers and alkali metal and ammonium salts thereof and methacroylethylbetaine/methacrylate copolymers.

Other preferred polymers are amphoteric polymers which, in addition to one or more anionic monomers, contain methacrylamidoalkyl trialkyl ammonium chloride and dimethyl (diallyl) ammonium chloride as cationic monomers.

Particularly preferred amphoteric polymers emanate from the group of methacrylamidoalkyl trialkyl ammonium chloride/dimethyl(diallyl) ammonium chloride/acrylic acid copolymers, methacrylamidoalkyl trialkyl ammonium chloride/dimethyl(diallyl) ammonium chloride/methacrylic acid copolymers and methacrylamidoalkyl trialkyl ammonium chloride/dimethyl(diallyl) ammonium chloride/alkyl (meth) acrylc acid copolymers and alkali metal and ammonium salts thereof.

Amphoteric polymers from the group of methacrylamidopropyl trimethyl ammonium chloride/dimethyl(diallyl) ammonium chloride/acrylic acid copolymers, methacrylamidopropyl trimethyl ammonium chloride/dimethyl(diallyl) ammonium chloride/acrylic acid copolymers and methacrylamidopropyl trimethyl ammonium chloride/dimethyl(diallyl) ammonium chloride/alkyl (meth)acrylic acid copolymers and alkali metal and ammonium salts thereof are particularly preferred.

The detergents according to the invention contain at least one anionic polymer modified with phosphorus- and/or sulfur-containing groups, the pH value of a 1% by weight solution of the anionic polymer in distilled water at 20° C. being below pH 6.

Preferred anionic polymers emanate from the groups of (1) vinyl acetate/crotonic acid copolymers,
(2) vinyl pyrrolidone/vinyl acrylate copolymers,
(3) acrylic acid/ethyl acrylate/N-tert.butyl acrylamide terpolymers,
(4) graft polymers of vinyl esters, esters of acrylic acid or methacrylic acid individually or in admixture copolymerized with crotonic acid, acrylic acid or methacrylic acid with polyalkylene oxides and/or polyalkylene glycols,
(5) grafted and crosslinked copolymers from the copolymerization of
  (5i) at least one monomer of the nonionic type,
  (5ii) at least one monomer of the ionic type,
  (5iii) polyethylene glycol and
  (5iv) a crosslinking agent,
(6) copolymers obtained by copolymerization of at least one monomer of each of the following three groups:
  (6i) esters of unsaturated alcohols and short-chain saturated carboxylic acids and/or esters of short-chain saturated alcohols and unsaturated carboxylic acids,
  (6ii) unsaturated carboxylic acids,
  (6iii) esters of long-chain carboxylic acids and unsaturated alcohols and/or esters of the carboxylic acids of group d6ii) with saturated or unsaturated, linear or branched $C_{8-18}$ alcohols,
(7) terpolymers of crotonic acid, vinyl acetate and an allyl or methallyl ester,
(8) tetrapolymers and pentapolymers of
  (8i) crotonic acid or allyloxyacetic acid,
  (8ii) vinyl acetate or vinyl propionate,
  (8iii) branched allyl or methallyl esters,
  (8iv) vinyl ethers, vinyl esters or straight-chain allyl or methallyl esters,
(9) crotonic acid copolymers with one or more monomers from the group consisting of ethylene, vinyl benzene, vinyl methyl ether, acrylamide and water-soluble salts thereof,
(10) terpolymers of vinyl acetate, crotonic acid and vinyl esters of a saturated aliphatic monocarboxylic acid branched in the α-position.

The anionic polymer is modified with phosphorus- and/or sulfur-containing groups, the pH value of a 1% by weight solution of the anionic polymer in distilled water at 20° C. being less than pH 6.

Preferred dishwasher detergents according to the invention are characterized in that the anionic polymer is at least partly modified with phosphorus-containing groups selected from phosphoric acid groups and/or phosphonic acid groups and/or phosphites and/or phosphine oxides.

Preferred anionic polymers substituted by P groups contain the following monomer units:

(i) unsaturated carboxylic acids,
(ii) monomers containing phosphate groups and/or monomers containing phosphonate groups and/or monomers containing phosphite groups and/or monomers containing phosphine oxide groups
(iii) optionally other ionic and nonionic monomers.

According to the invention, preferred monomers are unsaturated carboxylic acids corresponding to formula (I):

$$R^1(R^2)C{=}C(R^3)COOH \quad (1),$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (I), acrylic acid ($R^1{=}R^2{=}R^3{=}H$), methacrylic acid ($R^1{=}R^2{=}H; R^3{=}CH_3$) and/or maleic acid ($R^1{=}COOH$; $R^2{=}R^3{=}H$) are particularly preferred.

Monomers containing phosphate groups correspond to formula (II):

$$R^5(R^6)C{=}C(R^7)—X—PO_4H \quad (II),$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulas (IIa), (IIb) and/or (IIc):

$$H_2C{=}CH—X—PO_4H \quad (IIa)$$

$$H_2C{=}C(CH_3)—X—PO_4H \quad (IIb)$$

$$HO_4P—X—(R^6)C{=}C(R^7)—X—PO_4H \quad (IIc),$$

in which $R^6$ and $R^7$ independently of one another are selected from —H, —$CH_3$, —$CH_2CH_3$, —$CH_2CH_2CH_3$, —CH$(CH_3)_2$ and X is an optionally present spacer group selected from —$CH_2)_n$— with n=0 to 4, —COO—$(CH_2)_k$— with k=1 to 6, —C(O)—NH—$C(CH_3)_2$— and —C(O)—NH—CH$(CH_2CH_3)$—, are preferred.

Monomers containing phosphonate groups correspond to general formula (III):

$$R^5(R^6)C{=}C(R^7)—X—PO_3H \quad (III),$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulas (IIIa), (IIIb) and/or (IIIc):

$$H_2C{=}CH—X—PO_3H \quad (IIIa)$$

$$H_2C{=}C(CH_3)—X—PO_3H \quad (IIIb)$$

$$HO_4P—X—(R^6)C{=}C(R^7)—X—PO_3H \quad (IIIc),$$

in which $R^6$ and $R^7$ independently of one another are selected from —H, —$CH_3$, —$CH_2CH_3$, —$CH_2CH_2CH_3$, —CH$(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, are preferred.

Monomers containing phosphite groups correspond to general formula (IV):

$$R^5(R^6)C{=}C(R^7)—X—P(O)(OM^1)_2 \quad (IV),$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulas (IVa), (IVb) and/or (IVc):

$$H_2C{=}CH—X—P(O)(OM^1)_2 \quad (IVa)$$

$$H_2C{=}C(CH_3)—X—P(O)(OM^1)_2 \quad (IVb)$$

$$HO_4P—X—(R^6)C{=}C(R^7)—X—P(O)(OM^1)_2 \quad (IVc)$$

in which $R^6$ and $R^7$ independently of one another are selected from —H, —$CH_3$, —$CH_2CH_3$, —$CH_2CH_2CH_3$, —CH$(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, $M^1$ standing for hydrogen or a monovalent metal ion, preferably sodium, are preferred.

Monomers containing phosphine oxide groups correspond to formula (V):

$$R^5(R^6)C{=}C(R^7)—X—P(O)R^8R^9 \quad (V),$$

in which $R^5$ to $R^9$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulas (Va), (Vb) and/or (Vc):

$$H_2C{=}CH—X—P(O)R^8R^9 \quad (Va)$$

$$H_2C{=}C(CH_3)—X—P(O)R^8R^9 \quad (Vb)$$

$$HO_4P—X—(R^6)C{=}C(R^7)—X—P(O)R^8R^9 \quad (Vc),$$

in which $R^6$ and $R^7$ independently of one another are selected from —H, —$CH_3$, —$CH_2CH_3$, —$CH_2CH_2CH_3$, —CH $(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—, are preferred.

Particularly preferred dishwasher detergents according to the invention are characterized in that the polymer modified with phosphorus-containing groups at least partly contains terminal phosphorus-containing groups.

The detergents according to the invention may contain varying amounts of the polymers mentioned. Preferred dishwasher detergents according to the invention are characterized in that they contain the polymer(s) modified with phosphorus-containing groups preferably in quantities of 0.1 to 20% by weight, more preferably in quantities of 0.2 to 10% by weight and most preferably in quantities of 0.5 to 7.5% by weight, based on the detergent as a whole.

Irrespective of the observations made on the individual polymers, preferred dishwasher detergents according to the invention are characterized in that the polymer(s) modified with phosphorus-containing groups have average molecular weights of 1,000 to 10,000,000 $gmol^{-1}$, preferably in the range from 1,500 to 1,000,000 $gmol^{-1}$, more preferably in the range from 2,000 to 100,000 $gmol^{-1}$ and most preferably in the range from 2,500 to 50,000 $gmol^{-1}$.

Corresponding observations may also be made on the degrees of polymerization. Preferred dishwasher detergents according to the invention are characterized in that the polymer(s) modified with phosphorus-containing groups have a degree of polymerization of 10 to 10,000, preferably in the range from 20 to 5,000, more preferably in the range from 40 to 2,000 and most preferably in the range from 80 to 1,000.

In preferred polymers—irrespective of whether the phosphorus-containing groups are phosphates, phosphonates, phosphites or phosphine oxides—the molar ratio of the monomers i) to the monomers ii) is 1:1 to 200:1, preferably 1:1 to 100:1 and more particularly 1:1 to 10:1.

Particularly preferred dishwasher detergents according to the invention are characterized in that the polymer(s) modified with phosphorus-containing groups have a phosphorus content of 0.5 to 5.0% by weight, preferably 0.7 to 4.0% by weight and more particularly 0.9 to 3.0% by weight, based on the total weight of the phosphorus-containing polymer(s).

Irrespective of whether the phosphorus-containing groups are phosphates, phosphonates, phosphites or phosphine oxides, preferred dishwasher detergents according to the invention are characterized in that the polymers contain at most 20 mol-%, preferably at most 10 mol-% and more particularly at most 5 mol-% of monomers (iii).

Other preferred dishwasher detergents according to the invention are characterized in that the anionic polymer is at least partly modified with sulfur-containing groups.

The monomer units of these polymers may contain the sulfur, for example, in the form of thiol groups or sulfur bound as sulfide. In addition, the sulfur may be bound to the monomer, for example, as sulfenic acid, sulfonium salt, sulfinic acid, sulfoxide, sulfimide, sulfene, sulfonic acid, sulfone or sulfoximide (sulfonimide) or sulfate. Particularly preferred dishwasher detergents according to the invention are characterized in that the anionic polymer is at least partly modified with sulfonic acid groups.

According to the invention, preferred monomers for the polymers containing sulfonic acid groups are, again, unsaturated carboxylic acids corresponding to formula (I):

$$R^1(R^2)C{=}C(R^3)COOH \quad (I),$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (I), acrylic acid ($R^1{=}R^2{=}R^3{=}H$), methacrylic acid ($R^1{=}R^2{=}H; R^3{=}CH_3$) and/or maleic acid ($R^1{=}COOH$; $R^2{=}R^3{=}H$) are particularly preferred.

Preferred monomers containing sulfonic acid groups correspond to formula (VI):

$$R^5(R^6)C{=}C(R^7)—X—SO_3H \quad (VI),$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

Among these monomers, those corresponding to formulas (VIa), (VIb) and/or (VIc):

$$H_2C{=}CH—X—SO_3H \quad (VIa)$$

$$H_2C{=}C(CH_3)—X—SO_3H \quad (VIb)$$

$$HO_3S—X—(R^6)C{=}C(R^7)—X—SO_3H \quad (VIc)$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—, are preferred.

Particularly preferred monomers containing sulfonic acid groups are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)-propanesulfonic acid, 2-methyl-2-propene-1-sulfonic acid, styrenesulfonic acid, vinylsulfonic acid, 3-sulfopropylacrylate, 3-sulfopropylmethacrylate, sulfomethacrylamide, sulfomethylmethacrylamide and water-soluble salts of the acids mentioned.

Suitable other ionic or nonionic monomers are, in particular, ethylenically unsaturated compounds. The polymers used in accordance with the invention preferably contain less than 20% by weight, based on polymer, of monomers belonging to group (iii). Particularly preferred polymers consist solely of monomers belonging to groups (i) and (ii).

To sum up, copolymers of (i) unsaturated carboxylic acids corresponding to formula (I):

$$R^1(R^2)C{=}C(R^3)COOH \quad (I)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, (ii) monomers containing sulfonic acid groups corresponding to formula (VI):

$$R^5(R^6)C{=}C(R^7)—X—SO_3H \quad (VI)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, (iii) optionally other ionic or nonionic monomers, are particularly preferred.

Particularly preferred copolymers consist of (i) one or more unsaturated carboxylic acids from the group consisting of acrylic acid, methacrylic acid and/or maleic acid, (ii) one or more monomers containing sulfonic acid groups corresponding to formulas (VIa), (VIb) and/or (VIc):

$$H_2C{=}CH—X—SO_3H \quad (VIa)$$

$$H_2C{=}C(CH_3)—X—SO_3H \quad (VIb)$$

$$HO_3S—X—(R_6)C{=}C(R^7)—X—SO_3H \quad (VIc),$$

in which $R^6$ and $R^7$ independently of one another are selected from —H, —$CH_3$, —$CH_2CH_3$, —$CH_2CH_2CH_3$, —CH$(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, (iii) optionally other ionic or nonionic monomers.

The copolymers used may contain the monomers belonging to groups (i) and (ii) and optionally (iii) in varying quantities, all representatives of group (i) being combinable with all representatives of group (ii) and all representatives of group (iii). Particularly preferred polymers contain certain structural units which are described in the following.

For example, preferred compositions according to the invention are characterized in that they contain one or more copolymers containing structural units corresponding to formula (VII):

$$—[CH_2—CHCOOH]_m—[CH_2—CHC(O)—Y—SO_3H]_p— \quad (VII),$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH$(CH_2CH_3)$— being preferred.

These polymers are produced by copolymerization of acrylic acid with an acrylic acid derivative containing sulfonic acid groups. If the acrylic acid derivative containing sulfonic acid groups is copolymerized with methacrylic acid, another polymer is obtained which is also preferably used in the compositions according to the invention and which is characterized in that the compositions contain one or more copolymers which contain structural units corresponding to formula (VIII):

$$—[CH_2—C(CH_3)COOH]_m—[CH_2—CHC(O)—Y—SO_3H]_p— \quad (VIII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH$(CH_2CH_3)$— being preferred.

Entirely analogously, acrylic acid and/or methacrylic acid may also be copolymerized with methacrylic acid derivatives containing sulfonic acid groups, so that the structural units in the molecule are changed. Thus, compositions according to the invention containing one or more copolymers containing structural units corresponding to formula (IX):

$$—[CH_2—CHCOOH]_m—[CH_2—C(CH_3)C(O)—Y—SO_3H]_p— \quad (IX),$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH$(CH_2CH_3)$— being preferred, represent another preferred embodiment of the invention, as do compositions which are characterized in that they contain one or more copolymers containing structural units corresponding to formula (X):

$$—[CH_2—C(CH_3)COOH]_m—[CH_2—C(CH_3)C(O)—Y—SO_3H]_p— \quad (IX)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH$(CH_2CH_3)$— being preferred.

Maleic acid may also be used as a particularly preferred group (i) monomer instead of or in addition to acrylic acid and/or methacrylic acid. In this way, it is possible to arrive at preferred compositions according to the invention which are characterized in that they contain one or more copolymers containing structural units corresponding to formula (X):

$$—[HOOCCH—CHCOOH]_m—[CH_2—CHC(O)—Y—SO_3H]_p— \quad (X),$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH$(CH_2CH_3)$— being preferred, and at compositions which are characterized in that they contain one or more copolymers containing structural units corresponding to formula (XI):

$$—[HOOCCH—CHCOOH]_m—[CH_2—C(CH_3)C(O)O—Y—SO_3H]_p— \quad (XI),$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

To sum up, preferred compositions according to the invention contain one or more copolymers containing structural units corresponding to formulas (VI) and/or (VII) and/or (VII) and/or (IX) and/or (X) and/or (XI)

$$—[CH_2—CHCOOH]_m—[CH_2—CHC(O)—Y—SO_3H]_p— \quad (VI)$$

$$—[CH_2—C(CH_3)COOH]_m—[CH_2—CHC(O)—Y—SO_3H]_p— \quad (VII)$$

$$—[CH_2—C(CH_3)COOH]_m—[CH_2—C(CH_3)C(O)—Y—SO_3H]_p— \quad (VIII)$$

$$—[CH_2—C(CH_3)COOH]_m—[CH_2—C(CH_3)C(O)—Y—SO_3H]_p— \quad (IX)$$

$$—[HOOCCH—CHCOOH]_m—[CH_2—CHC(O)—Y—SO_3H]_p— \quad (X)$$

$$—[HOOCCH—CHCOOH]_m—[CH_2—C(CH_3)C(O)O—Y—SO_3H]_p— \quad (XI),$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

The sulfonic acid groups may be present in the polymers completely or partly in neutralized form, i.e. the acidic hydrogen atom of the sulfonic acid groups being replaceable by metal ions, preferably alkali metal ions and more particularly sodium ions, in some or all of the sulfonic acid groups. Corresponding compositions which are characterized in that the sulfonic acid groups in the copolymer are present in partly or fully neutralized form represent a preferred embodiment of the invention.

In the case of copolymers which only contain group (i) and group (ii) monomers, the monomer distribution in the compositions according to the invention is preferably 5 to 95% by weight (i) or (ii) and more preferably 50 to 90% by weight group (i) monomer and 10 to 50% by weight group (ii) monomer, based in each case on the polymer.

Particularly preferred terpolymers contain 20 to 85% by weight group (i) monomer, 10 to 60% by weight group (ii) monomer and 5 to 30% by weight group (iii) monomer.

The molecular weight of the polymers used in the compositions according to the invention may be varied in order to adapt the properties of the polymers to the particular application envisaged. Preferred compositions are characterized in that the copolymers have molecular weights of 2,000 to 200,000 $gmol^{-1}$, preferably in the range from 4,000 to 25,000 $gmol^{-1}$ and more particularly in the range from 5,000 to 15,000 $gmol^{-1}$.

To sum up, preferred dishwasher detergents according to the invention are characterized in that the polymer modified with phosphorus- and/or sulfur-containing groups contains (i) unsaturated carboxylic acids
(ii) phosphorus- and/or sulfur-containing monomers
(iii) optionally other ionic or nonionic monomers.

As already stated in reference to the P-containing polymers, preferred dishwasher detergents according to the invention are characterized in that the polymer modified with phosphorus- and/or sulfur-containing groups at least partly contains terminal phosphorus- and/or sulfur-containing groups.

Analogously to the quantities mentioned above for the P-containing polymers, preferred dishwasher detergents according to the invention are characterized in that they contain the polymer(s) modified with phosphorus- and/or sulfur-containing groups preferably in quantities of 0.1 to 20% by weight, more preferably in quantities of 0.2 to 10% by weight and most preferably in quantities of 0.5 to 7.5% by weight, based on the detergent as a whole.

Preferred dishwasher detergents according to the invention are characterized in that the polymer(s) modified with phosphorus- and/or sulfur-containing groups have average molecular weights of 1,000 to 10,000,000 $gmol^{-1}$, preferably in the range from 1,500 to 1,000,000 $gmol^{-1}$, more preferably in the range from 2,000 to 100,000 $gmol^{-1}$ and most preferably in the range from 2,500 to 50,000 $gmol^{-1}$.

The average degree of polymerization of the polymers may also be analogously stated. Preferred dishwasher detergents according to the invention are characterized in that the polymer(s) modified with phosphorus-containing groups have a degree of polymerization of 10 to 10,000, preferably in the range from 20 to 5,000, more preferably in the range from 40 to 2,000 and most preferably in the range from 80 to 1,000.

In addition, particularly preferred dishwasher detergents according to the invention are characterized in that the molar ratio of the monomers (i) to the monomers (ii) is 1:1 to 200:1, preferably 1:1 to 100:1 and more particularly 1:1 to 10:1.

As already mentioned, terpolymers of the above-mentioned monomers (i) to (iii) can be produced and used. However, the content of monomers (iii) is preferably limited. Preferred dishwasher detergents according to the invention are characterized in that the polymers contain at most 20 mol-%, preferably at most 10 mol-% and more particularly at most 5 mol-% of monomers (iii).

Preferred dishwasher detergents according to the invention additionally contain one or more surfactants, preferably nonionic surfactant(s).

The content of nonionic surfactants in the detergents according to the invention is preferably limited. Other surfactants are used in dishwasher detergents in only small quantities—well below 1% by weight, based on the detergent. By using the modified polymers, the quantity of surfactant can be reduced without any loss of performance and other advantageous properties, for example, better tableting behavior in the case of detergent tablets, can be obtained.

Preferred dishwasher detergents according to the invention have a nonionic surfactant content below 5% by weight, preferably below 4% by weight and more particularly between 0.01 and 2% by weight, based on the total weight of the dishwasher detergent.

The surfactants are described in the following. They emanate from the group of anionic, non ionic, cationic and/or amphoteric surfactants, nonionic surfactants being clearly preferred for machine dishwashing and surfactants from the other groups being used in only small quantities, if at all.

The anionic surfactants used are, for example, those of the sulfonate and sulfate type. Preferred surfactants of the sulfonate type are $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example, by sulfochlorination or sulfoxidation and subsequent hydrolysis or neutralization. The esters of α-sulfofatty acids (ester sulfonates), for example, the α-sulfonated methyl esters of hydrogenated coconut oil, palm kernel oil or tallow fatty acids, are also suitable.

Other suitable anionic surfactants are sulfonated fatty acid glycerol esters, i.e. the monoesters, diesters and triesters and mixtures thereof which are obtained where production is carried out by esterification of a monoglycerol with 1 to 3 mol fatty acid or in the transesterification of triglycerides with 0.3 to 2 mol glycerol. Preferred sulfonated fatty acid glycerol esters are the sulfonation products of saturated $C_{6-22}$ fatty acids, for example, caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example, coconut alcohol, tallow alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates are particularly preferred from the washing performance point of view. Other suitable anionic surfactants are 2,3-alkyl sulfates which are commercially obtainable as products of the Shell Oil Company under the name of DAN®.

The sulfuric acid monoesters of linear or branched $C_{7-21}$ alcohols ethoxylated with 1 to 6 mol ethylene oxide, such as 2-methyl-branched $C_{9-11}$ alcohols containing on average 3.5 mol ethylene oxide (EO) or $C_{12-18}$ fatty alcohols containing 1 to 4 EO, are also suitable. In view of their high foaming capacity, they are normally used in only relatively small quantities, for example, in quantities of 1 to 5% by weight, in dishwashing detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example, coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Another group of detersive substances are the nonionic surfactants. Preferred nonionic surfactants are alkoxylated, advantageously ethoxylated, more especially primary alcohols preferably containing 8 to 18 carbon atoms and, on average, 1 to 12 mol ethylene oxide (EO) per mol alcohol, in which the alcohol group may be linear or, preferably, methyl-branched in the 2-position or may contain linear and methyl-branched groups in the form of the mixtures typically present in oxoalcohol groups. However, alcohol ethoxylates containing linear groups of alcohols of native origin with 12 to 18 carbon atoms, for example, coconut, palm, tallow or oleyl alcohol, and on average 2 to 8 EO per mol alcohol are particularly preferred. Preferred ethoxylated alcohols include, for example, $C_{12-14}$ alcohols containing 3 EO or 4 EO, $Cg_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially fatty acid methyl esters.

Another class of nonionic surfactants which may advantageously be used are the alkyl polyglycosides (APGs). Suitable alkyl polyglycosides correspond to the general formula $RO(G)_z$ where R is a linear or branched, more particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of glycosidation is between 1.0 and 4.0, preferably between 1.0 and 2.0 and more preferably between 1.1 and 1.4. Linear alkyl polyglucosides, i.e. alkyl polyglycosides consisting of a glucose unit and an n-alkyl chain, are preferably used.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain.

Nonionic surfactants of the amine oxide type, for example, N-cocoalkyl-N,N-dimethylamine oxide and N-tallowalkyl-N,N-dihydroxyethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (XII):

$$R-CO-\overset{\overset{\displaystyle R^1}{|}}{N}-[Z], \quad \text{(XII)}$$

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (XIII):

$$R-CO-\overset{\overset{\displaystyle R^1-O-R^2,}{|}}{N}-[Z] \quad \text{(XIII)}$$

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example, glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

In the case of dishwasher detergents, the surfactants used may again generally be selected from any surfactants. However, the nonionic surfactants described above are preferably used for this particular application, low-foaming nonionic surfactants being particularly suitable. Alkoxylated alcohols, above all ethoxylated and/or propoxylated alcohols, are particularly preferred. The expert generally understands alkoxylated alcohols to be the reaction products of alkylene oxide, preferably ethylene oxide, with alcohols, preferably—for the purposes of the present invention—relatively long-chain alcohols ($C_{10}$ to $C_{18}$, preferably $C_{12}$ to $C_{16}$, such as for example, $_{C11}$, $C_{12}$, $C_{13}$, $C_{14}$, $C_{15}$, $C_{16}$, $C_{17}$ and $C_{18}$ alcohols). In general, a complex mixture of addition products with different degrees of ethoxylation is formed from n mol ethylene oxide and 1 mol alcohol, depending on the reaction conditions. Another embodiment consists in the use of mixtures of alkylene oxide, preferably a mixture of ethylene oxide and propylene oxide. If desired, "end-capped" alcohol ethoxylates, which may also be used in accordance with the invention, may also be obtained by etherification with short-chain alkyl groups, such as preferably the butyl group, in a concluding step. Highly ethoxylated fatty alcohols or mixtures thereof with end-capped fatty alcohol ethoxylates are most particularly preferred for the purposes of the invention.

According to the invention, particularly preferred nonionic surfactants are low-foaming nonionic surfactants which contain alternating ethylene oxide and alkylene oxide units. Preferred representatives of these surfactants are those which contain EO-AO-EO-AO blocks where one to ten EO or AO groups are attached to one another before a block of the other groups follows. Preferred dishwasher detergents produced in accordance with the invention are characterized in that they contain as nonionic surfactant(s) surfactants corresponding to general formula XIV:

$$R^1-O-(CH_2-CH_2-O)_w-(CH_2-\underset{\underset{\displaystyle R^2}{|}}{CH}-O)_x-(CH_2-CH_2-O)_y-(CH_2-\underset{\underset{\displaystyle R_3}{|}}{CH}-O)_z-H, \quad \text{(XIV)}$$

in which $R^1$ is a linear or branched, saturated or mono- or polyunsaturated $C_{6-24}$ alkyl or alkenyl group; the groups $R^2$ and $R^3$ independently of one another are each selected from $-CH_3$; $-CH_2CH_3$, $-CH_2CH_2-CH_3$, $-CH(CH_3)_2$ and the indices w, x, y and z independently of one another stand for integers of 1 to 6.

Preferred nonionic surfactants of formula (III) may be obtained by known methods from the corresponding alcohols $R^1-OH$ and ethylene or alkylene oxide. The substituent $R^1$ in formula (I) may vary according to the origin of the alcohol. If native sources are used, the substituent $R^1$ has an even number of carbon atoms and is generally unbranched, the linear chains of alcohols of native origin containing 12 to 18 carbon atoms, for example, of coconut oil, palm oil, tallow fatty alcohol or oleyl alcohol being preferred. Alcohols obtainable from synthetic sources are, for example, the Guerbet alcohols or 2-methyl-branched or linear or methyl-branched alcohols as normally present in oxoalcohols. Irrespective of the nature of the alcohol used to produce the nonionic surfactants present in accordance with the invention in the detergents, preferred dishwasher detergents according to the invention are those where $R^1$ in formula (I) is a $C_{6-24}$, preferably $C_{8-20}$, more preferably $C_{9-15}$ and most preferably $C_{9-11}$ alkyl group.

Besides propylene oxide, butylene oxide in particular may be the alkylene oxide unit which is present in alternation with the ethylene oxide unit in the preferred nonionic surfactants. However, other alkylene oxides where $R^2$ and $R^3$ independently of one another are selected from $-CH_2CH_2-CH_3$ or $-CH(CH_3)_2$ are also suitable. Preferred dishwasher detergents are characterized in that $R^2$ or $R^3$ represents a group $-CH_3$, w and x independently of one another have values of 3 or 4 and y and z independently of one another have values of 1 or 2.

To sum up, nonionic surfactants containing a $C_{9-15}$ alkyl group with 1 to 4 ethylene oxide units followed by 1 to 4 propylene oxide units followed by 1 to 4 ethylene oxide units followed by 1 to 4 propylene oxide units are preferred for use in the detergents according to the invention.

Low-foaming nonionic surfactants are used as preferred additional surfactants. In a particularly preferred embodiment, the dishwasher detergents according to the invention contain a nonionic surfactant which has a melting point above room temperature. Accordingly, preferred detergents are characterized in that they contain (a) nonionic surfactant(s) with a melting point above 20° C., preferably above 25° C., more preferably between 25 and 60° C. and, more particularly, between 26.6 and 43.3° C.

Suitable nonionic surfactants with melting or softening points in the temperature range mentioned above, which are present in addition to the nonionic surfactants present in the detergents in accordance with the invention, are, for example, low-foaming nonionic surfactants which may be solid or highly viscous at room temperature. If nonionic surfactants highly viscous at room temperature are used, they preferably have a viscosity above 20 Pas, more preferably above 35 Pas and most preferably above 40 Pas. Nonionic surfactants which are wax-like in consistency at room temperature are also preferred.

Preferred nonionic surfactants solid at room temperature belong to the groups of alkoxylated nonionic surfactants, more particularly ethoxylated primary alcohols, and mixtures of these surfactants with structurally complex surfactants, such as polyoxypropylene/polyoxyethylene/polyoxypropylene (PO/EO/PO) surfactants. In addition, (PO/EO/PO) nonionic surfactants are distinguished by good foam control.

In one preferred embodiment of the present invention, the nonionic surfactant with a melting point above room temperature is an ethoxylated nonionic surfactant emanating from the reaction of a monohydroxyalkanol or alkylphenol containing 6 to 20 carbon atoms with preferably at least 12 mol, more preferably at least 15 mol and most preferably at least 20 mol of ethylene oxide per mole of alcohol or alkylphenol.

A particularly preferred nonionic surfactant solid at room temperature is obtained from a straight-chain fatty alcohol containing 16 to 20 carbon atoms ($C_{16-20}$ alcohol), preferably a $C_{18}$ alcohol, and at least 12 mol, preferably at least 15 mol and more preferably at least 20 mol of ethylene oxide. Of these nonionic surfactants, the so-called narrow range ethoxylates (see above) are particularly preferred.

Accordingly, particularly preferred detergents according to the invention contain ethoxylated nonionic surfactant(s) obtained from $C_{6-20}$ monohydroxy-alkanols or $C_{6-20}$ alkylphenols or $C_{16-20}$ fatty alcohols and more than 12 mol, preferably more than 15 mol and more particularly more than 20 mol ethylene oxide per mol alcohol.

The nonionic surfactant preferably also contains propylene oxide units in the molecule. These PO units preferably make up as much as 25% by weight, more preferably as much as 20% by weight and, most preferably, up to 15% by weight of the total molecular weight of the nonionic surfactant. Particularly preferred nonionic surfactants are ethoxylated monohydroxyalkanols or alkylphenols which additionally contain polyoxyethylene/polyoxypropylene block copolymer units. The alcohol or alkylphenol component of these nonionic surfactant molecules preferably makes up more than 30% by weight, more preferably more than 50% by weight and most preferably more than 70% by weight of the total molecular weight of these nonionic surfactants. Preferred dishwasher detergents produced by the process according to the invention are characterized in that they contain ethoxylated and propoxylated nonionic surfactants where the propylene oxide units in the molecule make up as much as 25% by weight, preferably 20% by weight and more particularly up to 15% by weight of the total molecular weight of the nonionic surfactant.

Other particularly preferred nonionic surfactants with melting points above room temperature contain 40 to 70% of a polyoxypropylene/polyoxyethylene/polyoxpropylene block polymer blend which contains 75% by weight of an inverted block copolymer of polyoxyethylene and polyoxypropylene with 17 mol ethylene oxide and 44 mol propylene oxide and 25% by weight of a block copolymer of polyoxyethylene and polyoxypropylene initiated with trimethylol propane and containing 24 mol ethylene oxide and 99 mol propylene oxide per mol trimethylol propane.

Nonionic surfactants which may be used with particular advantage are obtainable, for example, under the name of Poly Tergent® SLF-18 from Olin Chemicals.

Another preferred dishwasher detergent according to the invention contains nonionic surfactants corresponding to the following formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15.

Other preferred nonionic surfactants are the end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5. Where x has a value of $\geqq 2$, each substituent $R^3$ in the above formula may be different. $R^1$ and $R^2$ are preferably linear or branched, saturated or unsaturated, aliphatic or aromatic hydrocarbon radicals containing 6 to 22 carbon atoms, radicals containing 8 to 18 carbon atoms being particularly preferred. For the substituent $R^3$, H, —$CH_3$ or —$CH_2CH_3$ are particularly preferred. Particularly preferred values for x are in the range from 1 to 20 and more particularly in the range from 6 to 15.

As mentioned above, each substituent $R^3$ in the above formula may be different where x is $\geqq 2$. In this way, the alkylene oxide unit in the square brackets can be varied. If, for example, x has a value of 3, the substituent $R^3$ may be selected to form ethylene oxide ($R^3$=H) or propylene oxide ($R^3$=$CH_3$) units which may be joined together in any order, for example, (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to:

$$R^1O[CH_2CH(R^3)O]_xCH_2CH(OH)CH_2OR^2$$

In this formula, $R^1$, $R^2$ and $R^3$ are as defined above and x has a value of 1 to 30, preferably 1 to 20 and more preferably 6 to 18. Surfactants in which the substituents $R^1$ and $R^2$ have 9 to 14 carbon atoms, $R^3$ stands for H and x has a value of 6 to 15 are particularly preferred.

To sum up, preferred dishwasher detergents according to the invention according to the invention are those which contain end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5, surfactants of the following type:

$$R^1O[CH_2CH(R^3)O]_xCH_2CH(OH)CH_2OR^2$$

where x has a value of 1 to 30, preferably 1 to 20 and more preferably 6 to 18, being particularly preferred.

Anionic, cationic and/or amphoteric surfactants may also be used in conjunction with the surfactants mentioned although they are of only minor importance for dishwasher detergents in view of their foaming behavior and are generally only used in quantities below 10% by weight, mostly even below 5% by weight, for example, in quantities of 0.01 to 2.5% by weight, based on the detergent. Accordingly, the detergents according to the invention may also contain anionic, cationic and/or amphoteric surfactants as a surfactant component.

Besides the ingredients mentioned above, preferred dishwasher detergents according to the invention also contain one or more substances from the group of builders, co-builders, bleaching agents, bleach activators, enzymes, dyes, corrosion inhibitors, polymers or other typical ingredients of detergents. These ingredients are described in the following:

Builders

According to the invention, any of the builders typically used in detergents and cleaning compositions, more particularly silicates, carbonates, organic cobuilders and even the phosphates, may be incorporated in the detergents and cleaning compositions.

Suitable crystalline layered sodium silicates correspond to the general formula $NaMSi_xO_{2x+1}.yH_2O$, where M is sodium or hydrogen, x is a number of 1.9 to 4 and y is a number of 0 to 20, preferred values for x being 2, 3 or 4. Preferred crystalline layered silicates corresponding to the above formula are those in which M is sodium and x assumes the value 2 or 3. Both β- and δ-sodium disilicates $Na_2Si_2O_5.yH_2O$ are particularly preferred.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example, by surface treatment, compounding/compacting or by overdrying. In the context of the invention, the term "amorphous" is also understood to encompass "X-ray amorphous." In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. Compacted amorphous silicates, compounded amorphous silicates and overdried X-ray-amorphous silicates are particularly preferred.

The detergents may contain both the monoalkali metal salts and the dialkali metal salts of carbonic acid and sesquicarbonates as carbonates. Preferred alkali metal ions are sodium and/or potassium ions. In one preferred embodiment, the carbonate and/or bicarbonate may be at least partly separately or subsequently incorporated as another component. Compounds of, for example, carbonate, silicate and optionally other auxiliaries such as, for example, anionic surfactants or other, more particularly organic, builders may also be present as separate components in the final compositions.

The generally known phosphates may of course also be used as builders providing their use should not be avoided on ecological grounds. Among the large number of commercially available phosphates, alkali metal phosphates have the greatest importance in the detergent industry, pentasodium triphosphate and pentapotassium triphosphate (sodium and potassium tripolyphosphate) being particularly preferred.

"Alkali metal phosphates" is the collective term for the alkali metal (more particularly sodium and potassium) salts of the various phosphoric acids, including metaphosphoric acids $(HPO_3)_n$ and orthophosphoric acid ($H_3PO_4$) and representatives of higher molecular weight. The phosphates combine several advantages: they act as alkalinity sources, prevent lime deposits on machine parts and lime incrustations in fabrics and, in addition, contribute towards the cleaning effect.

Sodium dihydrogen phosphate ($NaH_2PO_4$) exists as the dihydrate (density 1.91 $gcm^{-3}$, melting point 60°) and as the monohydrate (density 2.04 $gcm^{-3}$). Both salts are white readily water-soluble powders which, on heating, lose the water of crystallization and, at 200° C., are converted into the weakly acidic diphosphate (disodium hydrogen diphosphate, $Na_2H_2P_2O_7$) and, at higher temperatures, into sodium trimetaphosphate ($Na_3P_3O_9$) and Maddrell's salt (see below). $NaH_2PO_4$ shows an acidic reaction. It is formed by adjusting phosphoric acid with sodium hydroxide to a pH value of 4.5 and spraying the resulting "mash."Potassium dihydrogen phosphate (primary or monobasic potassium phosphate, potassium biphosphate, KDP), $KH_2PO_4$, is a white salt with a density of 2.33 $gcm^{-3}$, has a melting point of 253° [decomposition with formation of potassium polyphosphate $(KPO_3)_x$] and is readily soluble in water.

Disodium hydrogen phosphate (secondary sodium phosphate), $Na_2HPO_4$, is a colorless, readily water-soluble crystalline salt. It exists in water-free form and with 2 mol (density 2.066 $gcm^{-3}$, water loss at 95° C.), 7 mol (density 1.68 $gcm^{-3}$, melting point 48° C. with loss of $5H_2O$) and 12 mol of water (density 1.52 $gcm^{-3}$, melting point 35° C. with loss of $5H_2O$), becomes water-free at 100° C. and, on fairly intensive heating, is converted into the diphosphate $Na_4P_2O_7$. Disodium hydrogen phosphate is prepared by neutralization of phosphoric acid with soda solution using phenolphthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, consists of colorless crystals which have a density of 1.62 $gcm^{-3}$ and a melting point of 73-76° C. (decomposition) as the dodecahydrate, a melting point of 100° C. as the decahydrate (corresponding to 19-20% $P_2O_5$) and a density of 2.536 $gcm^{-3}$ in water-free form (corresponding to 39-40% $P_2O_5$). Trisodium phosphate is readily soluble in water through an alkaline reaction and is prepared by concentrating a solution of exactly 1 mol disodium phosphate and 1 mol NaOH by evaporation. Tripotassium phosphate (tertiary or tribasic potassium phosphate), $K_3PO_4$, is a white deliquescent granular powder with a density of 2.56 $gcm^{-3}$, has a melting point of 1,340° and is readily soluble in water through an alkaline reaction. It is formed, for example, when Thomas slag is heated with coal and potassium sulfate. Despite their higher price, the more readily soluble and therefore highly effective potassium phosphates are often preferred to corresponding sodium compounds in the detergent industry.

Tetrasodium diphosphate (sodium pyrophosphate), $Na_4P_2O_7$, exists in water-free form (density 2.534 $gcm^{-3}$, melting point 988° C., a figure of 880° C. has also been mentioned) and as the decahydrate (density 1.815-1.836 $gcm^{-3}$, melting point 94° with loss of water). Both substances are colorless crystals which dissolve in water through an alkaline reaction. $Na_4P_2O_7$ is formed when disodium phosphate is heated to >200° C. or by reacting phosphoric acid with soda in a stoichiometric ratio and spray-drying the solution. The decahydrate complexes heavy metal salts and hardness salts and, hence, reduces the hardness of water. Potassium diphosphate (potassium pyrophosphate), $K_4P_2O_7$, exists in the form of the trihydrate and is a colorless hygroscopic powder with a density of 2.33 $gcm^{-3}$ which is soluble in water, the pH value of a 1% solution at 25° C. being 10.4.

Relatively high molecular weight sodium and potassium phosphates are formed by condensation of $NaH_2PO_4$ or $KH_2PO_4$. They may be divided into cyclic types, namely the sodium and potassium metaphosphates, and chain types, the sodium and potassium polyphosphates. The chain types in particular are known by various different names: fused or calcined phosphates, Graham's salt, Kurrol's salt and Maddrell's salt. All higher sodium and potassium phosphates are known collectively as condensed phosphates.

The industrially important pentasodium triphosphate, $Na_5P_3O_{10}$ (sodium tripolyphosphate), is a non-hygroscopic white water-soluble salt which crystallizes without water or with $6H_2O$ and which has the general formula NaO—[P(O)(ONa)—O]$_n$—Na where n=3. Around 17 g of the salt free from water of crystallization dissolve in 100 g of water at room temperature, around 20 g at 60° and around 32 g at 100°. After heating of the solution for 2 hours to 100°, around 8% orthophosphate and 15% diphosphate are formed by hydrolysis. In the preparation of pentasodium triphosphate, phosphoric acid is reacted with soda solution or sodium hydroxide in a stoichiometric ratio and the solution is spray-dried. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is marketed for example, in the form of a 50% by weight solution (>23% $P_2O_5$,25% $K_2O$). The potassium polyphosphates are widely used in the detergent industry. Sodium potassium tripolyphosphates, which may also be used in accordance with the invention, also exist. They are formed, for example, when sodium trimetaphosphate is hydrolyzed with KOH:

$$(NaPO_3)_3+2KOH \rightarrow Na_3K_2P_3O_{10}+H_2O.$$

According to the invention, they may be used in exactly the same way as sodium tripolyphosphate, potassium tripolyphosphate or mixtures thereof. Mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate may also be used in accordance with the invention.

According to the invention, preferred dishwasher detergents contain no sodium and/or potassium hydroxide. The absence of sodium and/or potassium hydroxide as an alkali source has proved to be of advantage in particular when zinc gluconate, zinc formate and zinc acetate are used as zinc salts.

Cobuilders

Organic cobuilders which may be used in the dishwasher detergents according to the invention include, in particular, polycarboxylates/polycarboxylic acids, polymeric polycarboxylates, aspartic acid, polyacetals, dextrins, other organic cobuilders (see below) and phosphonates. The polymers may also be part of the active-component matrix, although they may also be present in the detergents according to the invention completely independently of that matrix. The classes of substances mentioned are described in the following.

Useful organic builders are, for example, the polycarboxylic acids usable in the form of their sodium salts, polycarboxylic acids in this context being understood to be carboxylic acids which carry more than one acid function. These include, for example, citric acid, adipic acid, succinic acid, glutaric acid, malic acid, tartaric acid, maleic acid, fumaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Other suitable builders are polymeric polycarboxylates, i.e., for example, the alkali metal salts of polyacrylic or polymethacrylic acid, for example, those with a relative molecular weight of 500 to 70,000 g/mol.

The molecular weights mentioned in this specification for polymeric polycarboxylates are weight-average molecular weights $M_w$ of the particular acid form which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification.

Particularly suitable polymers are polyacrylates which preferably have a molecular weight of 1,000 to 20,000 g/mol. By virtue of their superior solubility, preferred representatives of this group are the short-chain polyacrylates which have molecular weights of 1,000 to 10,000 g/mol and, more particularly, 1,200 to 4,000 g/mol.

In a particularly preferred embodiment, the detergents according to the invention contain both polyacrylates and copolymers of unsaturated carboxylic acids, monomers containing sulfonic acid groups and optionally other ionic or nonionic monomers. The copolymers containing sulfonic acid groups are described in detail in the following.

In addition, the polymers containing sulfonic acid groups described in the foregoing may of course also be present in the detergents according to the invention without necessarily having to be part of the active-component matrix.

As mentioned above, both polyacrylates and the above-described copolymers of unsaturated carboxylic acids, monomers containing sulfonic acid groups and optionally other ionic or nonionic monomers are used in a particularly preferred embodiment of the detergents according to the invention. The polyacrylates are described in detail in the foregoing. Combinations of the above-described copolymers containing sulfonic acid groups with low molecular weight polyacrylates, for example, with molecular weights of 1,000 to 4,000 dalton, are particularly preferred. Such polyacrylates are commercially available under the names of Sokalan® PA15 and Sokalan® PA25 (BASF).

Also suitable are copolymeric polycarboxylates, particularly those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weights, based on the free acids, are generally in the range from 2,000 to 100,000 g/mol, preferably in the range from 20,000 to 90,000 g/mol and more preferably in the range from 30,000 to 80,000 g/mol.

The (co)polymeric polycarboxylates may be used either in powder form or in the form of an aqueous solution. The content of (co)polymeric polycarboxylates in the foams is preferably 0.5 to 20% by weight and more particularly 3 to 10% by weight.

In order to improve solubility in water, the polymers may also contain allyl sulfonic acids such as, for example, allyloxybenzene sulfonic acid and methallyl sulfonic acid as monomer.

Other particularly preferred polymers are biodegradable polymers of more than two different monomer units, for example, those which contain salts of acrylic acid and maleic acid and vinyl alcohol or vinyl alcohol derivatives as monomers or those which contain salts of acrylic acid and 2-alkylallyl sulfonic acid and sugar derivatives as monomers.

Other preferred copolymers are those which preferably contain acrolein and acrylic acid/acrylic acid salts or acrolein and vinyl acetate as monomers.

Other preferred builders are polymeric aminodicarboxylic acids, salts or precursors thereof. Polyaspartic acids or salts and derivatives thereof are particularly preferred.

Other suitable builders are polyacetals which may be obtained by reaction of dialdehydes with polyol carboxylic acids containing 5 to 7 carbon atoms and at least three hydroxyl groups. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable organic builders are dextrins, for example, oligomers or polymers of carbohydrates which may be obtained by partial hydrolysis of starches. The hydrolysis may be carried out by standard methods, for example, acid- or enzyme-catalyzed methods. The end products are preferably hydrolysis products with average molecular weights of 400 to 500,000 g/mol. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 g/mol may be used.

The oxidized derivatives of such dextrins are their reaction products with oxidizing agents which are capable of oxidizing at least one alcohol function of the saccharide ring to the carboxylic acid function. A product oxidized at $C_6$ of the saccharide ring can be particularly advantageous.

Other suitable co-builders are oxydisuccinates and other derivatives of disuccinates, preferably ethylenediamine disuccinate. Ethylenediamine-N,N'-disuccinate (EDDS) is preferably used in the form of its sodium or magnesium salts. Glycerol disuccinates and glycerol trisuccinates are also preferred in this connection. The quantities used in zeolite-containing and/or silicate-containing formulations are from 3 to 15% by weight.

Other useful organic co-builders are, for example, acetylated hydroxycarboxylic acids and salts thereof which may optionally be present in lactone form and which contain at least 4 carbon atoms, at least one hydroxy group and at most two acid groups.

Another class of substances with co-builder properties are the phosphonates, more particularly hydroxyalkane and aminoalkane phosphonates. Among the hydroxyalkane phosphonates, 1-hydroxyethane-1,1-diphosphonate (HEDP) is particularly important as a co-builder. It is preferably used in the form of the sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylenephosphonate (DTPMP) and higher homologs thereof. They are preferably used in the form of the neutrally reacting sodium salts, for example, as the hexasodium salt of EDTMP or as the hepta- and octasodium salts of DTPMP. Of the phosphonates, HEDP is preferably used as a builder. In addition, the aminoalkane phosphonates have a pronounced heavy metal binding capacity. Accordingly, it can be of advantage, particularly where the foams also contain bleach, to use aminoalkane phosphonates, more particularly DTPMP, or mixtures of the phosphonates mentioned.

In addition, any compounds capable of forming complexes with alkaline earth metal ions may be used as co-builders.

According to the present application, detergents according to the invention are characterized in that they contain builders, preferably from the group of silicates, carbonates, organic cobuilders and/or phosphates, in quantities of 0.1 to 99.5% by weight, preferably in quantities of 1 to 95% by weight, more preferably in quantities of 5 to 90% by weight and most preferably in quantities of 10 to 80% by weight, based on the detergent.

Bleaching Agents

Bleaching agents and bleach activators are important constituents of detergents and, according to the invention, a detergent may contain one or more substances from the groups mentioned. Among the compounds yielding $H_2O_2$ in water which serve as bleaching agents, sodium percarbonate is particularly important. Other useful bleaching agents are, for example, sodium perborate tetrahydrate and sodium perborate monohydrate, peroxopyrophosphates, citrate perhydrates and $H_2O_2$-yielding peracidic salts or per acids, such as perbenzoates, peroxophthalates, diperazelaic acid, phthaliminoperacid or diperdodecanedioic acid.

"Sodium percarbonate" is a non-specific term used for sodium carbonate peroxohydrates which, strictly speaking, are not "percarbonates" (i.e. salts of percarbonic acid), but hydrogen peroxide adducts with sodium carbonate. The commercial material has the mean composition $2\,Na_2CO_3.3H_2O_2$ and, accordingly, is not a peroxycarbonate. Sodium percarbonate forms a white water-soluble powder with a density of 2.14 $gcm^{-3}$ which readily decomposes into sodium carbonate and bleaching or oxidizing oxygen.

Sodium carbonate peroxohydrate was obtained for the first time in 1899 by precipitation with ethanol from a solution of sodium carbonate in hydrogen peroxide, but was mistakenly regarded as peroxycarbonate. It was only in 1909 that the compound was recognised as a hydrogen peroxide addition compound. Nevertheless, the historical name "sodium percarbonate" has been adopted in practice.

On an industrial scale, sodium percarbonate is mainly produced by precipitation from aqueous solution (so-called wet process). In this process, aqueous solutions of sodium carbonate and hydrogen peroxide are combined and the sodium percarbonate is precipitated by salting-out agents (mainly sodium chloride), crystallization aids (for example, polyphosphates, polyacrylates) and stabilizers (for example, $Mg^{2+}$ ions). The precipitated salt which still contains 5 to 12% by weight of mother liquor is then removed by centrifuging and dried at 90° C. in fluidized bed dryers. The bulk density of the end product can vary between 800 and 1200 g/l according to the production process. In general, the percarbonate is stabilized by an additional coating. Coating processes and materials are widely described in the patent literature. Basically, any commercially available percarbonate types as marketed, for example, by Solvay Interox, Degussa, Kemira and Akzo may be used in accordance with the present invention.

Dishwasher detergents may also contain bleaching agents from the group of organic bleaches. Typical organic bleaching agents which may be used as ingredients in accordance with the invention are diacyl peroxides, such as dibenzoyl peroxide, for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents for machine dishwashing according to the invention are chlorine- and bromine-releasing substances. Suitable chlorine- or bromine-releasing materials are, for example, heterocyclic N-bromamides and N-chloramides, for example, trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

Advantageous detergents according to the invention contain one or more bleaching agents, preferably from the group of oxygen or halogen bleaching agents, more particularly chlorine bleaching agents, and more preferably sodium percarbonate and/or sodium perborate monohydrate, in quantities of 0.5 to 40% by weight, preferably 1 to 30% by weight, more preferably 2.5 to 25% by weight and most preferably 5 to 20% by weight, based on the detergent as a whole.

Bleach Activators

In order to obtain an improved bleaching effect where cleaning is carried out at temperatures of 60° C. or lower, cleaning compositions according to the invention may contain bleach activators. Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the cleaning compositions. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Preferred detergents according to the invention contain one or more substances from the group of bleach activators, more particularly from the groups of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl- or isononanoyl-oxybenzenesulfonate (n- or iso-NOBS) and n-methyl morpholinium acetonitrile methyl sulfate (MMA), in quantities of 0.1% by weight to 20% by weight, more preferably in quantities of 0.5 to 15% by weight and, with particular advantage, in quantities of 1 to 10% by weight, based on the detergent as a whole.

Preferred bleach activators according to the invention also include "nitrilequats," i.e. cationic nitriles corresponding to formula (XV):

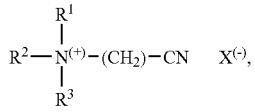

(XV)

in which $R^1$ represents —H, —$CH_3$, a $C_{2-24}$ alkyl or alkenyl group, a substituted $C_{2-24}$ alkyl or alkenyl group with at least one substituent from the group consisting of —Cl, —Br, —OH, —$NH_2$, —CN, an alkyl or alkenyl aryl group containing a $C_{1-24}$alkyl group or a substituted alkyl or alkenyl aryl group containing a $C_{1-24}$ alkyl group and at least one other substituent at the aromatic ring, $R^2$ and $R^3$ independently of one another are selected from —$CH_2$—CN, —$CH_3$, —$CH_2$—$CH_3$, —$CH_2$—$CH_2$-$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —$(CH_2CH_2—O)_n$H where n=1, 2, 3, 4, 5 or 6 and X is an anion.

General formula (XXI) encompasses a number of cationic nitriles which may be used in accordance with the present invention. In one particularly advantageous embodiment, the detergent tablets according to the invention contain cationic nitriles in which $R^1$ stands for methyl, ethyl, propyl, isopropyl or an n-butyl, n-hexyl, n-octyl, n-decyl, n-dodecyl, n-tetradecyl, n-hexadecyl or n-octadecyl group. $R^2$ and $R^3$ are preferably selected from methyl, ethyl, propyl, isopropyl and hydroxyethyl; one or both of these substituents may with advantage even be a cyanomethylene group.

In the interests of easier synthesis, preferred compounds are those in which the substituents $R^1$ to $R^3$ are identical, for example, $(CH_3)_3N^{(+)}CH_2—CN\ X^-$, $(CH_3CH_2)_3N^{(+)}CH_2—CN\ X^-$, $(CH_3CH_2CH_2)_3N^{(+)}CH_2—CN\ X^-$, $(CH_3CH(CH_3))_3N^{(+)}CH_2—CN\ X^-$ or $(HO—CH_2—CH_2)_3N^{(+)}CH_2—CN\ X^-$, where $X^-$ is preferably an anion selected from the group consisting of chloride, bromide, iodide, hydrogen sulfate, methosulfate, p-toluene sulfonate (tosylate) or xylene sulfonate.

Preferred detergents according to the invention are characterized in that they contain the cationic nitrile (XXI) in quantities of 0.1 to 20% by weight, preferably 0.25 to 15% by weight and more particularly 0.5 to 10% by weight, based on the weight of the tablet.

Enzymes

Suitable enzymes are, in particular, those from the classes of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process. In addition, cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as *Bacillus subtilis, Bacillus licheniformis, Streptomyces griseus, Coprinus cinereus* and *Humicola insolens* and from genetically modified variants are particularly suitable. Proteases of the subtilisin type are preferably used, proteases obtained from *Bacillus lentus* being particularly preferred. Of particular interest in this regard are enzyme mixtures, for example, of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases.

Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in membrane materials to protect them against premature decomposition. Preferred compositions produced in accordance with the invention contain enzymes, preferably in the form of liquid and/or solid enzyme preparations, in quantities of 0.1 to 10% by weight, preferably in quantities of 0.5 to 8% by weight and more particularly in quantities of 1 to 5% by weight.

Dyes

In order to improve their aesthetic impression, the detergents according to the invention may be colored with suitable dyes. According to the invention, preferred dyes, which are not difficult for the expert to choose, have high stability in storage, are not affected by the other ingredients of the compositions or by light and do not have any pronounced substantivity for textile fibers so as not to color them.

Any dyes which can be destroyed by oxidation in the washing process and mixtures thereof with suitable blue dyes, so-called blueing agents, are preferably used in the detergents according to the invention. It has proved to be of advantage to use dyes which are soluble in water or—at room temperature—in liquid organic substances. Suitable dyes are, for example, anionic dyes, for example, anionic nitroso dyes. One possible dye is, for example, naphthol green (Color Index (CI) Part 1: Acid Green 1; Part 2: 10020), which is commercially available, for example, as Basacid® Grün 970 from BASF, Ludwigshafen, and mixtures thereof with suitable blue dyes. Other suitable dyes are Pigmosol® Blau 6900 (CI 74160), Pigmosol® Grün 8730 (CI 74260), Basonyl® Rot 545 FL (CI 45170), Sandolan® Rhodamin EB 400 (CI 45100), Basacid® Gelb 094 (CI 47005), Sicovit® Patentblau 85 E 131 (CI 42051), Acid Blue 183 (CAS 12217-22-0, CI Acid Blue 183), Pigment Blue 15 (CI 74160), Supranol® Blau GLW (CAS 12219-32-8, CI Acid Blue 221)), Nylosan® Gelb N-7GL SGR (CAS 61814-57-1, CI Acid Yellow 218) and/or Sandolan® Blau (CI Acid Blue 182, CAS 12219-26-0).

In selecting the dye, it is important to ensure that the dye does not have an excessive affinity for the textile surfaces and, in particular, for synthetic fibers. Another factor to be taken into account in the selection of suitable dyes is that dyes differ in their stability to oxidation. Generally speaking, water-insoluble dyes are more stable to oxidation than water-soluble dyes. The concentration of the dye in the detergents varies according to its solubility and hence its sensitivity to oxidation. In the case of readily water-soluble dyes, for example, the above-mentioned Basacid® Grün and Sandolan® Blau, dye concentrations in the range from a few $10^{-2}$ to $10_{-3}$% by weight are typically selected. By contrast, in the case of the pigment dyes which are particularly preferred for their brilliance, but which are less readily soluble in water, for example, the above-mentioned Pigmosol® dyes, suitable concentrations of the dye in detergents are typically of the order of a few $10^{-3}$ to $10^{-4}$% by weight.

Perfumes

Suitable perfumes for the purposes of the invention include individual perfume compounds, for example, synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used.

Perfume oils such as these may also contain natural perfume mixtures obtainable from vegetable sources, for example, pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and ladanum oil and orange blossom oil, neroli oil, orange peel oil and sandalwood oil.

The general description of the perfumes suitable for use in accordance with the invention (see above) represents the various classes of perfumes in general terms. In order to be noticeable, a perfume has to be volatile, its molecular weight being an important factor along with the nature of the functional groups and the structure of the chemical compound. Thus, most perfumes have molecular weights of up to about 200 dalton, molecular weights of 300 dalton and higher being more the exception. In view of the differences in volatility of perfumes, the odor of a perfume or fragrance composed of several perfumes changes during the evaporation process, the odor impressions being divided into the top note, the middle note or body and the end note or dry out. Since odor perception is also based to a large extent on odor intensity, the top note of a perfume or fragrance does not consist solely of readily volatile compounds whereas the end note or dry out consists largely of less volatile, i.e. firmly adhering, perfumes. In the composition of perfumes, more readily volatile perfumes may be fixed, for example, to certain "fixatives," which prevents them from vaporizing too rapidly. Accordingly, in the following classification of perfumes into "readily volatile" and "firmly adhering" perfumes, nothing is said about the odor impression or about whether the corresponding perfume is perceived as a top note or middle note.

Firmly adhering perfumes suitable for use in accordance with the present invention are, for example, the essential oils, such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiac wood oil, Indian wood oil, helichrysum oil, ho oil, ginger oil, iris oil, cajeput oil, sweet flag oil, camomile oil, camphor oil, canaga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, palmarosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetivert oil, juniper berry oil, wormwood oil, wintergreen oil, ylang-ylang oil, ysop oil, cinnamon oil, cinnamon leaf oil, citronella oil, citrus oil and cypress oil.

However, relatively high-boiling or solid perfumes of natural or synthetic origin may also be used in accordance with the invention as firmly adhering perfumes or perfume mixtures. These compounds include those mentioned in the following and mixtures thereof: ambrettolide, α-amyl cinnamaldehyde, anethole, anisaldehyde, anisalcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valerate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl-n-amyl ketone, methyl anthranilic acid methyl ester, p-methyl acetophenone, methyl chavicol, p-methyl quinoline, methyl-β-naphthyl ketone, methyl n-nonyl acetaldehyde, methyl n-nonyl ketone, muskone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymene, thymol, γ-undecalactone, vanillin, veratrum aldehyde, cinnamaldehyde, cinnamyl alcohol, cinnamic acid, ethyl cinnamate, benzyl cinnamate.

The more readily volatile perfumes include, in particular, the relatively low-boiling perfumes of natural or synthetic origin which may be used either individually or in the form of mixtures. Examples of more readily volatile perfumes are alkyl isothiocyanates (alkyl mustard oils), butanedione, limonene, linalool, linalyl acetate and propionate, menthol, menthone, methyl n-heptenone, phellandrene, phenyl acetaldehyde, terpinyl acetate, citral, citronellal.

Corrosion Inhibitors

To protect the tableware or the machine itself, dishwasher detergents may contain corrosion inhibitors, silver protectors being particularly important for dishwashing machines. Known corrosion inhibitors may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. Chlorine-free dishwashing detergents contain in particular oxygen- and nitrogen-containing organic redox-active compounds, such as dihydric and trihydric phenols, for example, hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, particular preference being attributed to cobalt(ammine) complexes, cobalt (acetate) complexes, cobalt(carbonyl) complexes, chlorides of cobalt or manganese and manganese sulfate and to the manganese complexes $[\text{Me-TACN})\text{Mn}^{IV}(\text{m-0})_3\text{Mn}^{IV}(\text{Me-TACN})]^{2+}(\text{PF}_6^-)_2$ $[\text{Me-MeTACN})\text{Mn}^{IV}(\text{m-0})_3\text{Mn}^{IV}(\text{Me-MeTACN})]^{2+}(\text{PF}_6^-)_2$ $[\text{Me-TACN})\text{Mn}^{III}(\text{m-0})(\text{m-OAc})_2\text{Mn}^{III}(\text{Me-TACN})]^{2+}(\text{PF}_6^-)_2$ and $[\text{Me-TACN})\text{Mn}^{III}(\text{m-0})(\text{m-OAc})_2\text{Mn}^{III}(\text{Me-MeTACN})]^{2+}(\text{PF}_6^-)_2$ where Me-TACN stands for 1,4,7-trimethyl-1,4,7-triazacyclononane and Me-MeTACN for 1,2,4,7-tetramethyl-1,4,7-triazacyclononane. Zinc compounds may also be used to prevent corrosion to tableware.

A preferred glass corrosion inhibitor in cleaning and/or rinse cycles of a dishwashing machine is zinc in oxidized form, i.e. zinc compounds in which zinc is present as a cation. Magnesium salts are similarly preferred. Both soluble and poorly soluble or insoluble zinc or magnesium compounds may be used. Preferred compositions according to the invention contain one or more magnesium and/or zinc salts of at least one monomeric and/or polymeric organic acid.

The acids in question preferably emanate from the group of unbranched, saturated or unsaturated monocarboxylic acids, branched, saturated or unsaturated monocarboxylic acids, saturated and unsaturated dicarboxylic acids, aromatic mono-, di- and tricarboxylic acids, sugar acids, hydroxy acids, oxo acids, amino acids and/or polymeric carboxylic acids, unbranched or branched, unsaturated or saturated, mono- or polyhydroxylated fatty acids containing at least 8 carbon atoms and/or resin acids.

Although any magnesium and/or zinc salt(s) of monomeric and/or polymeric organic acids may be present in accordance with the invention, the magnesium and/or zinc salts of monomeric and/or polymeric organic acids from the groups of unbranched, saturated or unsaturated monocarboxylic acids, branched, saturated or unsaturated monocarboxylic acids, saturated and unsaturated dicarboxylic acids, aromatic mono-, di- and tricarboxylic acids, sugar acids, hydroxy acids, oxo acids, amino acids and/or polymeric carboxylic acids are preferred. Within these groups, the acids mentioned below are preferred for the purposes of the present invention:

From the group of unbranched, saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (oenanthic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachic acid), docosanoic acid (behenic acid), tetracosanoic acid (lignoceric acid), hexacosanoic acid (cerotic acid), triacontanoic acid (melissic acid), 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of branched, saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecancoic acid, 2-heptylundecanoic acid, 2-octyidodecanoic acid, 2-nonyltridecanoic acid, 2-decyl tetradecanoic acid, 2-undecylpentadecanoic acid, 2-dodecylhexadecanoic acid, 2-tridecylheptadecaoic acid, 2-tetradecyloctadecanoic acid, 2-pentadecyinonadecanoic acid, 2-hexadecyl eicosanoic acid, 2-heptadecylheneicosanoic acid.

From the group of unbranched, saturated or unsaturated di- or tricarboxylic acids: propanedioic acid (malonic acid, butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2-butinedicarboxylic acid (acetylene dicarboxylic acid).

From the group of aromatic mono-, di- and tricarboxylic acids: benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesic acid).

From the group of sugar acids: galactonic acid, mannonic acid, fructonic acid, arabinonic acid, xylonic acid, ribonic acid, 2-deoxyribonic acid, alginic acid.

From the group of hydroxy acids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propranetricarboxylic acid (citric acid), ascorbic acid, 2-hydroxybenzoic acid (salicylic acid), 3,4,5-trihydroxybenzoic acid (gallic acid).

From the group of oxo acids: 2-oxopropionic acid (pyruvic acid), 4-oxopentanoic acid (levulinic acid).

From the group of amino acids: alanine, valine, leucine, isoleucine, proline, tryptophane, phenylalanine, methionine, glycine, serine, tyrosine, threonine, cysteine, asparagine, glutamine, aspartic acid, glutamic acid, lysine, arginine, histidine.

From the group of polymeric carboxylic acids: polyacrylic acid, polymethacrylic acid, alkyl acrylamide/acrylic acid copolymers, alkyl acrylamide/methacrylic acid copolymers, alkyl acrylamide/methyl methacrylic acid copolymers, copolymers of unsaturated carboxylic acids, vinyl acetate/crotonic acid copolymers, vinyl pyrrolidone/vinyl acrylate copolymers.

The spectrum of preferred zinc salts of organic acids, preferably organic carboxylic acids, extends from salts which are poorly soluble or insoluble in water, i.e. which have a solubility below 100 mg/l, preferably below 10 mg/l and, more particularly, no solubility at all, to salts which have a solubility in water above 100 mg/l, preferably above 500 mg/l, more preferably above 1 g/l and most preferably above 5 g/l (all solubilities measured at a water temperature of 20° C.). The first group of zinc salts includes, for example, zinc citrate, zinc oleate and zinc stearate while the group of soluble zinc salts includes, for example, zinc formate, zinc acetate, zinc lactate and zinc gluconate.

In another preferred embodiment of the present invention, the compositions according to the invention contain at least one zinc salt, but no magnesium salt, of an organic acid, preferably at least one zinc salt of an organic carboxylic acid and more preferably at least one zinc salt from the group consisting of zinc stearate, zinc oleate, zinc gluconate, zinc acetate, zinc lactate and/or zinc citrate. Zinc ricinoleate, zinc abietate and zinc oxalate are also preferred zinc salts.

The invention claimed is:

1. A machine dishwasher detergent comprising at least one polymer comprising cationic monomer units, at least one anionic polymer modified with phosphorus- and/or sulfur containing groups containing as a monomer at least one unsaturated carboxylic acid selected from the group consisting of acrylic acid, methacrylic acid, maleic acid and mixtures thereof and at least one monomer containing sulfonic acid groups selected from the group consisting of 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)-propanesulfonic acid, 2-methyl-2-propene-1-sulfonic acid, vinylsulfonic acid, 3-sulfopropylacrylate, 3-sulfopropylmethacrylate, sulfomethacrylamide, sulfomethylmethacrylamide, water-soluble salts of the above-identified acids and mixtures thereof, and at least one non-ionic surfactant having a content below 5% by weight based on the total weight of the dishwasher detergent, wherein the pH value of a 1% by weight solution of the anionic polymer in distilled water is below 6 at 20° C.

2. A dishwasher detergent as claimed in claim 1, characterized in that the polymer with cationic monomer units is a cationic polymer.

3. The dishwasher detergent of claim 1 wherein the polymer comprising cationic monomer units is a cationic polymer further carrying anionic groups.

4. The dishwasher detergent of claim 1 wherein the anionic polymer is at least partly modified with phosphorus-containing groups selected from phosphoric acid groups, phosphonic acid groups, phosphates, phosphine oxides and combinations thereof.

5. The dishwasher detergent of claim 1 wherein the anionic polymer is at least partly modified with sulfonic acid groups.

6. The dishwasher detergent of claim 1 wherein the polymer modified with phosphorus- and/or sulfur-containing groups is further comprised of other ionic or nonionic monomers as monomer units.

7. The dishwasher detergent of claim 1 wherein the polymer modified with phosphorus- and/or sulfur-containing groups is comprised at least partially of terminal phosphorus- and/or sulfur-containing groups.

8. The dishwasher detergent of claim 1 wherein the amount of the phosphorus- and/or sulfur-containing groups is from 0.1 to 20% by weight.

9. The dishwasher detergent of claim 1 further comprising less than 4% by weight of a nonionic surfactant.

10. The dishwasher detergent of claim 1 wherein the average molecular weight of the polymer modified with phosphorus- and/or sulfur-containing groups is from 1,000 to 10,000,000 $gmol^{-1}$.

11. The dishwasher detergent of claim 1 wherein the average degree of polymerization of the polymer modified with phosphorus-containing groups is from 10 to 10,000.

12. The dishwasher detergent of claim 1 wherein the molar ratio of the monomers of at least one unsaturated carboxylic acid to at least one monomer containing sulfonic acid groups is 1:1 to 200:1.

13. The dishwasher detergent of claim 1 wherein the phosphorus content of the polymer modified with phosphorus-containing groups is from 0.5 to 5.0% by weight based on the total weight of the phosphorus-containing polymer(s).

14. The dishwasher detergent of claim 6 wherein the mole % of monomer (iii) is equal to or less than 20 mol-%.

* * * * *